US005084940A

United States Patent [19]

Loffler et al.

[11] Patent Number: 5,084,940

[45] Date of Patent: Feb. 4, 1992

[54] ADJUSTABLE HANDLESET

[75] Inventors: James M. Loffler, El Toro; Paul G. Solovieff, Tustin, both of Calif.

[73] Assignee: Emhart Inc., Newark, Del.

[21] Appl. No.: 466,897

[22] Filed: Jan. 18, 1990

[51] Int. Cl.[5] ..... E05B 1/00

[52] U.S. Cl. ..... 16/110 R; 292/356; 292/357; 16/DIG. 24

[58] Field of Search ..... 16/110 R, 124, 125, 16/DIG. 24; 292/357, 356, 347, 173, 221, 223, 166, 167, DIG. 37

[56] References Cited

U.S. PATENT DOCUMENTS

| | | | |
|---|---|---|---|
| 2,314,609 | 3/1943 | Curtiss, Jr. | 292/167 |
| 2,332,765 | 10/1943 | Thiele | 16/125 |
| 2,672,103 | 3/1954 | Hohmes | 16/125 |
| 3,101,965 | 8/1963 | Muttart | 292/357 |
| 4,042,268 | 8/1977 | Coglan | 292/347 |
| 4,930,820 | 5/1990 | Pettit et al. | 292/197 |

FOREIGN PATENT DOCUMENTS

| | | | |
|---|---|---|---|
| 0484122 | 5/1938 | United Kingdom | 16/125 |

*Primary Examiner*—Kurt Rowan
*Assistant Examiner*—James Miner
*Attorney, Agent, or Firm*—J. Bruce Hoofnagle

[57] ABSTRACT

An entrance handleset 20 is assembled on a door 22 and includes a handle 24 which is connected at an upper end to an upper rose 26 and at a lower end to a lower rose 28. A thumbpiece 30 extends from upper rose 26 just above the upper end of handle 24 to facilitate operation of a latch (not shown) which is assembled with door 22. At the juncture of handle 24 and upper rose 26, the handle is formed with a spherial face 26 recess 62 to permit swivel or universal adjustment of the handle relative to the upper rose.

12 Claims, 6 Drawing Sheets

FIG. 8
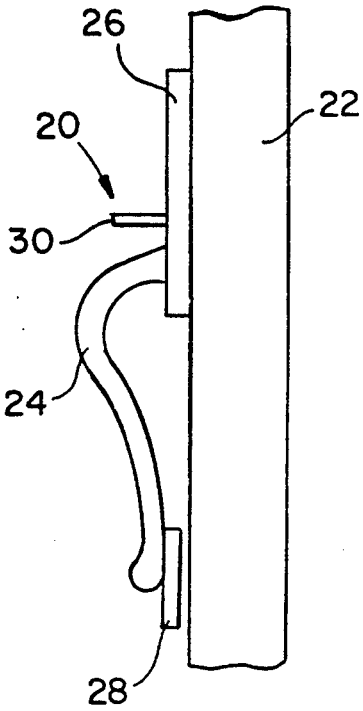
FIG. 9
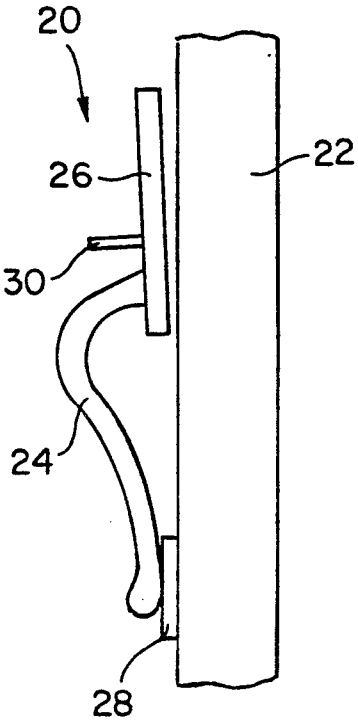
FIG. 11
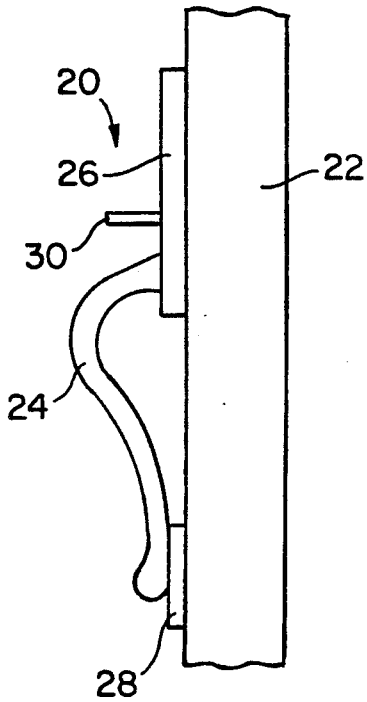
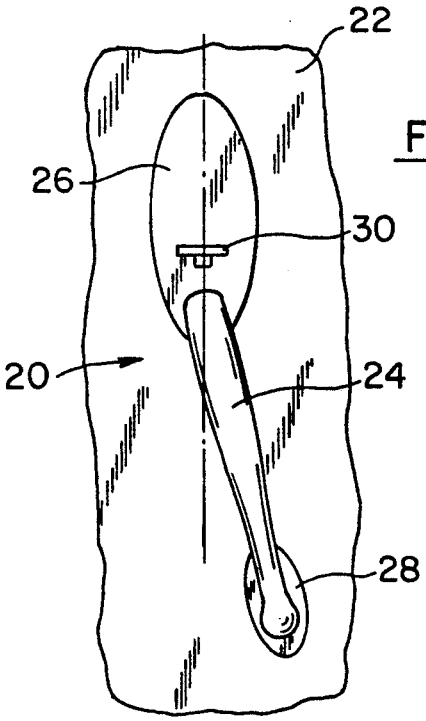
FIG. 10

ADJUSTABLE HANDLESET

BACKGROUND OF THE INVENTION

This invention relates to an adjustable handleset and particularly relates to a handleset having a handle which is adjustable with respect to a rose of the handleset.

An entrance handleset for assembly with a door typically includes a handle which is attached at an upper end thereof to an upper rose and at a lower end thereof to a lower smaller rose. Typically, the upper end of the handle is set flat against the outer surface of the rose, or is inserted into a cut-out of the rose, and is secured in position by a screw which is assembled from the other or rear side of the rose. A thumbpiece extends outwardly from the upper rose slightly above the location where the upper end of the handle is attached to the upper rose. The thumbpiece includes a portion which extends behind and is concealed within the upper rose and is attached to an operating mechanism which operates a door latch. Another portion of the thumbpiece is exposed externally of the upper rose to facilitate manipulation thereof in the operation of the door latch.

At a manufacturing location, the handle is assembled with the upper and lower roses as noted above. The concealed portion of the thumbpiece is positioned through an opening in the upper rose and is assembled with the operating mechanism to form a handleset unit which is then packaged for shipment and ultimate assembly with a door at a construction site.

During assembly of the elements of the handleset unit at the manufacturing location, the ends of the handle are attached to the upper and lower roses generally in an attempt to insure that door engaging faces of the upper and lower roses are in the same plane. In this manner, an on-site installer could merely place the door engaging rose faces of the roses against the exterior surface of the door in the appropriate location and proceed to assemble the handleset with other elements of the door latching arrangement.

However, due to the manner of attachment of the handle to the roses at the manufacturing location, and to minor structural variations and tolerances in different handles and different roses, the door engaging faces are frequently in different planes. Also, the upper and lower roses, as packaged, may be in such misalignment that they do not align vertically when assembled with a door.

In any event, where the door engaging surfaces of the roses are not in planar alignment, and/or the roses are not factory-assembled for ultimate vertical alignment on the door, the on-site installer must disassemble the handle from the roses and, after "trial and error" adjustment, reassemble the handleset elements prior to assembly on the door. This is a time consuming and aggravating nuisance for the installer.

In view of the foregoing, it is apparent that there is a need for a structural arrangement between the handle and at least one rose to facilitate installer-assembly of the handleset with the door with relative ease.

SUMMARY OF THE INVENTION

It is, therefore, an object of this invention to provide an improved handleset with adjustment capability to ease the installation of the handleset with a door.

Another object of this invention is to provide an improved handleset the elements of which can be assembled at the manufacturing location and which ultimately can be assembled with a door without the necessity of disassembling the elements of the handleset.

With these and other objects in mind, this invention contemplates an adjustable handleset which includes a handle assembled at a juncture with a rose. Means, interposed at the juncture of assembly, are provided for adjusting the position of the handle relative to the rose without complete separation and disassembly of the handle from the rose.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings:

FIGS. 8 and 9 show the handle attached at one end to the rose of FIGS. 5 and 6, positioned as an upper rose, and attached at the lower end to a lower rose and further shows that door-engaging faces of the upper and lower roses are not aligned in the same plane, and FIG. 10 shows the handleset assembled with a door wherein the door-engaging faces of the upper and lower roses of FIGS. 8 and 9 are aligned in the same plane.

FIG. 11 shows the upper and lower roses in vertical alignment.

DETAILED DESCRIPTION OF THE PREFERRED EMBODIMENT

Figure 1:
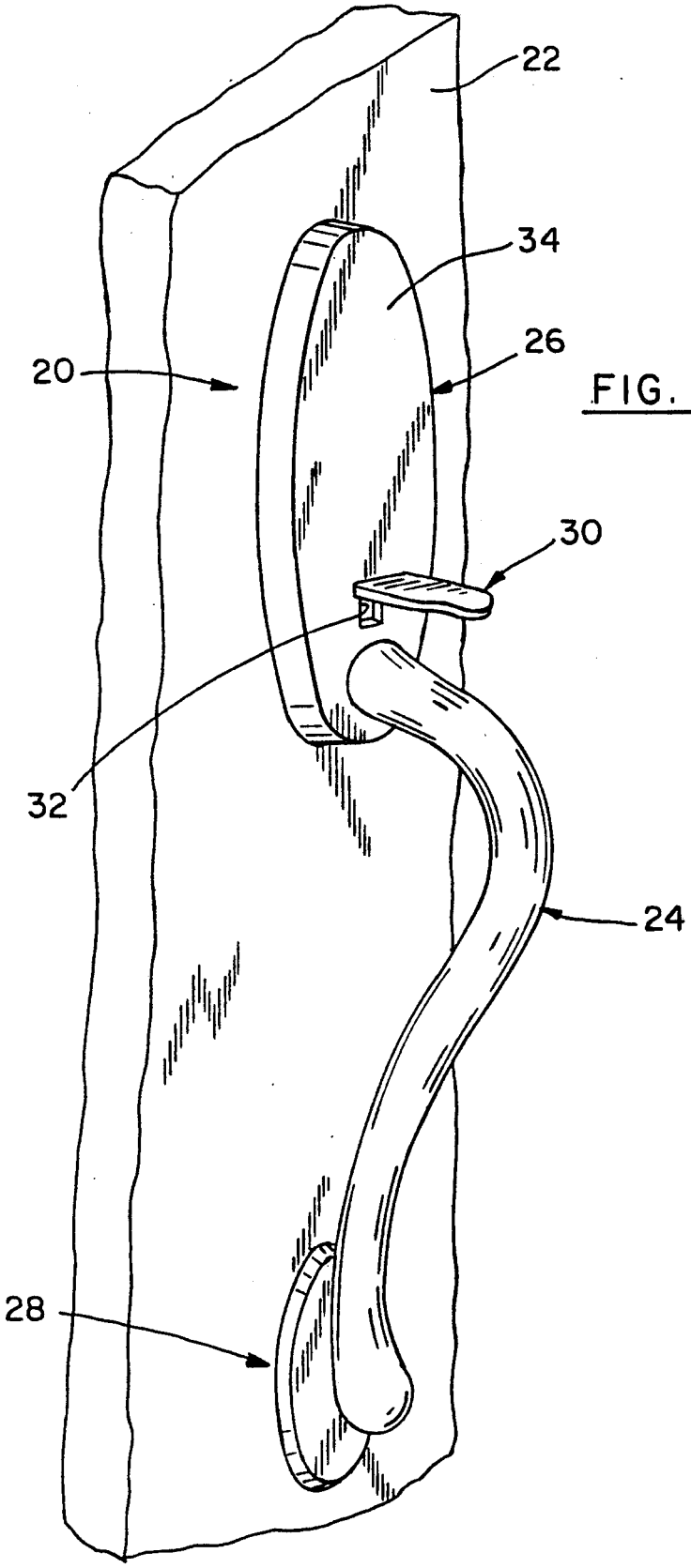
FIG. 1 is a perspective view showing an entrance handleset assembled with a door.

As illustrated in FIG. 1, a handleset 20 is assembled with a partially illustrated door 22 and includes a contoured handle 24 which is attached at one end thereof to an upper rose 26 and at the other end thereof to a lower rose 28 which is smaller than the upper rose. A thumbpiece 30 extends outwardly through an opening 32 formed in the upper rose 26.

The thumbpiece 30 is attached to a latch operating mechanism (not shown) located behind a front face 34 of rose 26 and the adjacent face of door 22 and facilitates operation of a door latch (not shown) by operator manipulation of the thumbpiece.

Figure 2:
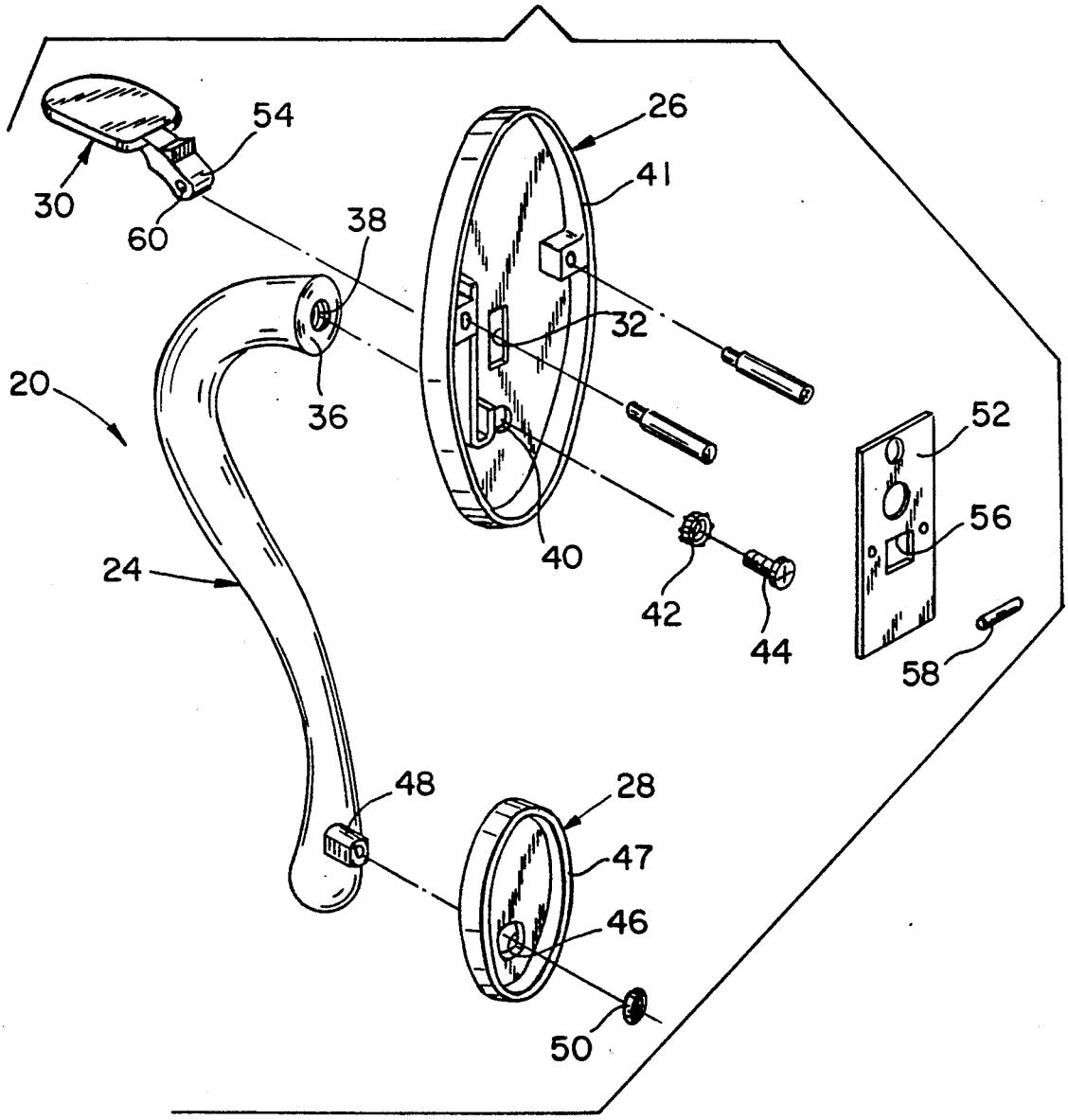
FIG. 2 is an exploded perspective view showing the elements of the handleset of FIG. 1.

Referring to FIG. 2, the elements of handleset 20 are illustrated in greater detail. Specifically, a face 36 is formed at the upper end of handle 24 and has a threaded aperture 38 formed centrally therein. Rose 26 is formed with through hole 40 which is aligned with threaded aperture 38 of handle 24. Rose 26 is also formed with a door-engaging surface 41. A lock washer 42 and a screw 44 are aligned with rose hole 40 and handle aperture 38 and provide the securing elements of handle 24 with rose 26. Lock washer 42 is of the type which has a plurality of teeth radially projecting outwardly from the outward periphery of the washer. The teeth are twisted slightly to provide biting edges which engage the inner wall of rose 26 when screw 44 is drawn tightly into handle aperture 38.

The lower rose 28 is formed with a through hole 46 which has arcuate upper and lower walls and straight parallel side walls. Rose 28 is also formed with a door-engaging surface 47. A boss 48 is secured to and projects from a side portion of the lower end of handle 24. The exterior surfaces of boss 48 conform structurally to the inner walls of hole 46 so that, after the boss has been inserted into the hole, handle 24 cannot be rotated about the axis of the boss relative to lower rose 28. After boss 48 has been inserted through hole 46, a retaining ring 50 is positioned over the inwardly exposed portion of the boss and is pressed against the adjacent inner wall of rose 28 to insure retention of handle 24 with the lower rose. Retaining ring 50 is of the type which includes an annular rim with radially inwardly extending fingers which are sprung outwardly from the plane of the rim in a direction opposite to the direction of movement of the ring onto boss 48.

It is noted that, while the illustrated embodiment shows boss 48, through hole 46 and retaining ring 50 arranged to facilitate retention of handle 24 with lower rose 28, the handle and the lower rose could be formed as a single element without departing from the spirit and scope of the invention.

Other elements of handleset 20 include the latch operating mechanisms (not shown) and a cover plate 52 which is attached to the back side of rose 26 to conceal the operating mechanism. A pivot tab 54 is formed on the inward end of thumbpiece 30 which is positioned through rose opening 32, as noted above, with the end of the tab extending through an opening 56 formed in cover plate 52. A pivot pin 58 is then inserted through a pivot hole 60 formed transaxially through the end of thumbpiece tab 54. A cover (not shown) is then positioned over the tab 54 with assembled pivot pin 58 and is attached to cover plate 52. In this manner, the pivoting end of thumbpiece 30 and pivot pin 58 are concealed and retained in place thereafter. This arrangement facilitates retention of thumbpiece 30 with rose 26 and permits the latch operating mechanism to be operated by depression of the thumbpiece toward handle 24.

Figure 3:
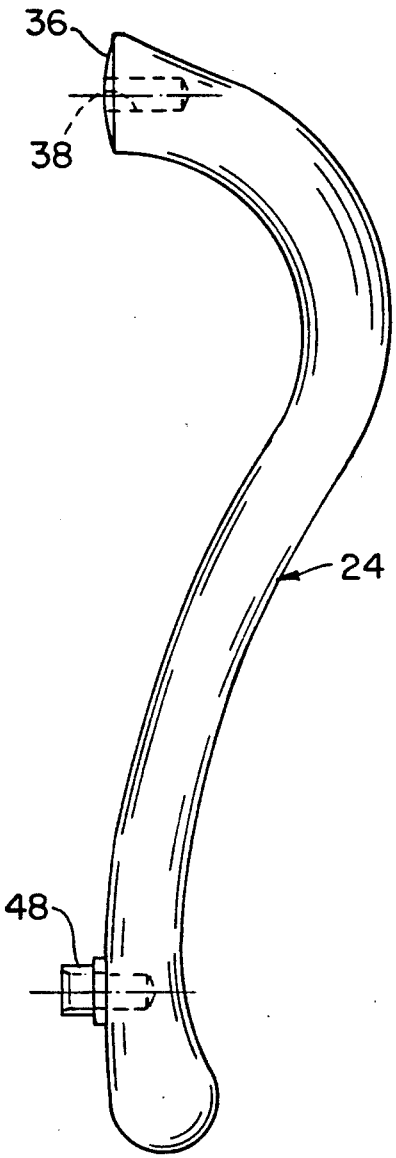
FIG. 3 is a side view showing a handle of the handleset of FIG. 1 and includes a side-view illustration of a spherical end face embodying, in part, certain principles of the invention.
Figure 4:
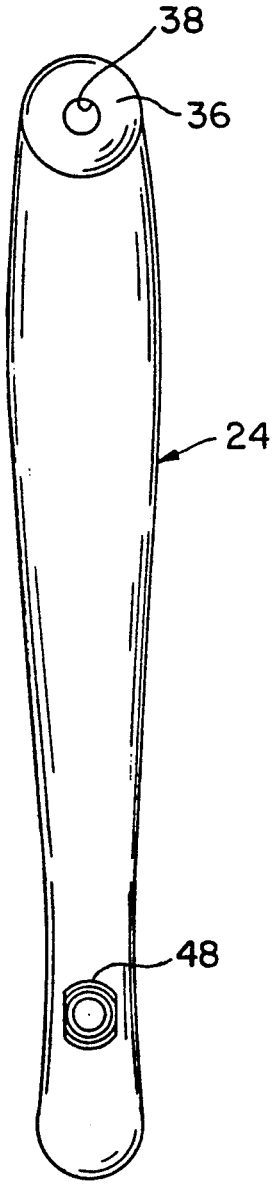
FIG. 4 is a rear view showing the handle of FIG. 3 and illustrates in full view the spherical end face of the handle.

The features of handle 24 are further illustrated in FIGS. 3 and 4 and reveal that face 36 is spherical having a prescribed spherical radius in accordance with certain principles of the invention. In the preferred embodiment, the spherical radius is two inches. However, other radii could be used without departing from the spirit and scope of the invention.

Figure 6:
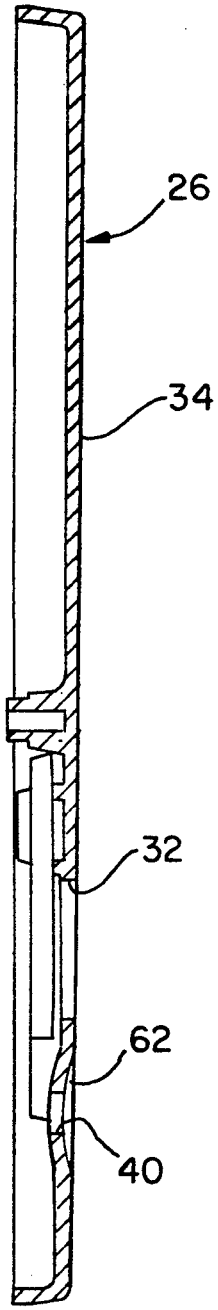
FIG. 6 is a sectional view of the rose of FIG. 5 and shows a sectional side view of the spherical recess on the front face thereof.
Figure 5:
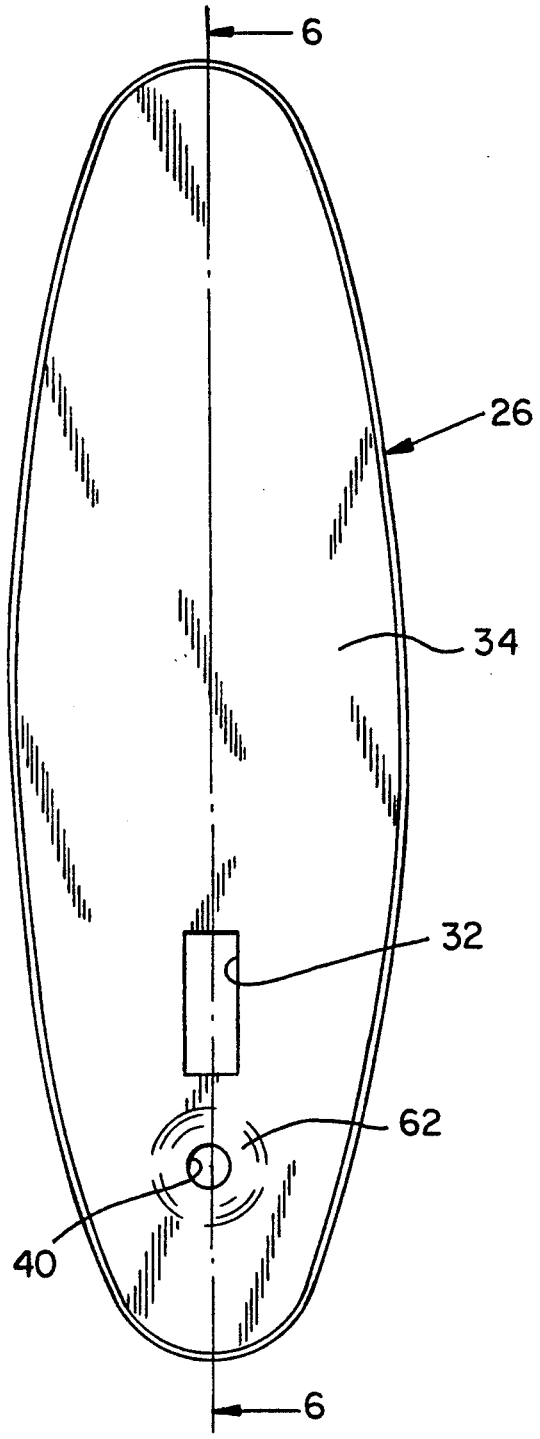
FIG. 5 is a front view of a rose which forms an element of the handleset of FIG. 1, and illustrates a spherical recess on the front face thereof which, in part, embodies certain principles of the invention.

Referring the FIGS. 5 and 6, front face 34 of rose 26 is formed with a spherical recess 62 which is located symmetrically about hole 40. Spherical recess 62 is formed with the prescribed spherical radius and, thereby, has the same radius as the spherical face 36 of handle 24 in accordance with certain principles of the invention.

Figure 7:
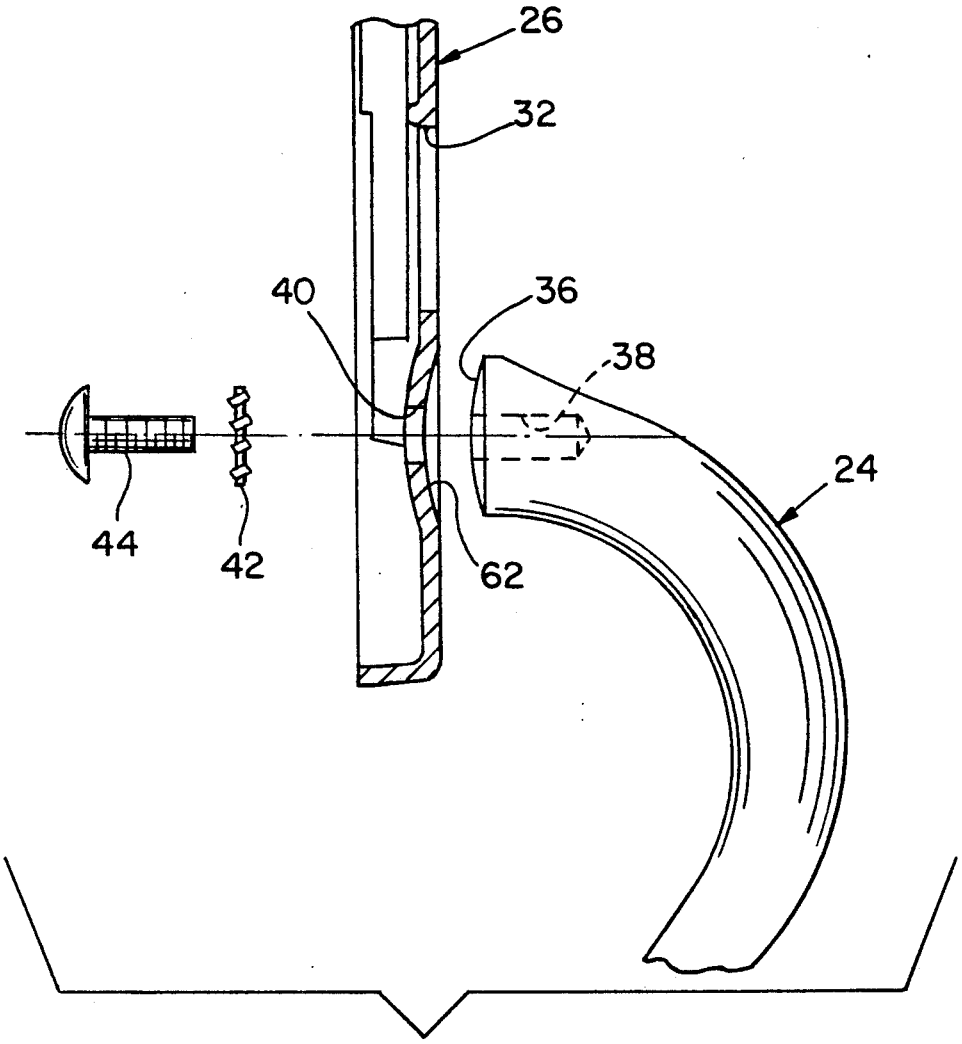
FIG. 7 is a partial-sectional side view showing the spherical face of the handle of FIGS. 3 and 4 positioned for assembly with the spherical recess of the rose of FIGS. 5 and 6 and embodying certain principles of the invention.

Referring now to FIG. 7, the upper end of handle 24 is positioned next to rose 26 so that spherical face 36 is aligned with spherical recess 62 of the rose and so that threaded aperture 38 is aligned axially with hole 40 in the rose. The spherical face 36 is then positioned within spherical recess 62 whereby the face and recess are concealed. Washer 42 and screw 44 are then assembled from within rose 26 whereby the washer bites into the inner wall of the rose and the threaded portion of the screw is threadedly moved into aperture 38 of handle 24. It is noted that the diameter of rose hole 40 is slightly larger than the outside diameter of the threaded portion of screw 44.

With the spherical arrangement as described above, face 36 and recess 62 are concealed. Thus, as viewed externally in FIG. 1 for example, the surfaces of engagement between handle 24 and rose 26 appear to be flat which provides a pleasing and decorative appearance.

The elements of handleset 20 are assembled at the manufacturing location in the manner noted above with the upper end of handle 24 attached to upper rose 26 and the lower end of the handle attached to lower rose 28. During assembly, an attempt is made to insure that door-engaging faces 41 and 47 of roses 26 and 28, respectively, are in the same plane and that the roses and handle 24 are aligned so as to be in vertical alignment when assembled with door 22. Handleset 20 is then packaged for shipment and ultimately reaches an installer who will assemble the handleset with door 22.

Frequently, when the package reaches the installer, the door-engaging surfaces 41 and 47 of roses 26 and 28, respectively, may not be in the same plane as illustrated in FIGS. 8 and 9. Also, the location of lower rose 28 may be skewed with respect to upper rose 26 as illustrated in FIG. 10. In any event, handleset 20 is to be assembled with door 22 so that handle 24 and roses 26 and 28 are in vertical alignment as illustrated in FIGS. 1 and 11 to provide optimum utilization of the handleset.

In the past, if the installer received a prepackaged handleset which did not include the interfacing spherical face 36 and spherical recess 62, the handleset would have to be dismantled and processed on site. The elements would then be reassembled whereafter the handleset was assembled with the door.

In view of the spherical face 36 of handle 24 being in facing relating with spherical recess 62 of rose 26, the installer merely loosens screw 44 to the extent that the handle is movable relative to the rose but is still attached thereto. The installer then moves handle 40 and rose 26 relative to each other to obtain the necessary planar alignment whereby door engaging surfaces of roses 26 and 28 are in the same plane. Also, the installer can simultaneously adjust handle 24 relative to rose 26 to align handle 24 and roses 26 and 28 to facilitate vertical alignment of the elements of handleset 20 when the handleset is assembled with door 22.

Since handle face 36 and rose recess 62 are spherical, handle 24 can be swivelled or moved universally relative to rose 26 within the limits of movement as permitted by the outside diameter of screw 44 and the larger diameter of hole 40. The swivel or universal movement can be effected in a single effort in a vectorial context thereby providing adjustment with relative ease, accuracy and quickness.

After the aligning adjustment has been made, the installer retightens screw 44 to firmly hold handle 24 and roses 26 and 28 in the desired alignment. The installer then proceeds to assemble handleset 20 with door 22.

Thus, the arrangement which includes spherical face 36 and spherical recess 62, together with screw 44, forms a means interposed at the juncture of assembly of handle 24 and rose 26 for adjusting the position of the handle relative to the rose without complete separation and disassembly of the handle from the rose.

The above-described inventive adjustment feature also provides for a more precise and relatively easier planar aligning of the door engaging surfaces 41 and 47 of roses 26 and 28, respectively, when the handleset elements are assembled at the manufacturing location. When the adjusted handleset arrives at the installation site, it is ready for installation without the need for further adjustment.

The lower end of handle 24 could also be formed with a spherical face in the same manner as the upper end thereof. The lower rose 28 would be formed with a spherical recess in the same manner as recess 62 is formed in upper rose 26. With such structure, handle 24 could also be adjusted with respect to lower rose 28.

The above-described embodiment, of course, is not to be construed as limiting the breadth of the present invention. Modifications, and other alternative constructions, will be apparent which are within the spirit and scope of the invention as defined in the appended claims.

What is claimed is:

1. An adjustable handleset, which comprises:
a rose;
a handle assembled with the rose at a juncture of assembly;
means, interposed at the juncture of assembly, for permitting adjustment of the position of the handle relative to the rose without complete separation and disassembly of the handle from the rose, and
means for firmly securing the handle with the rose at the juncture of assembly to preclude relative movement therebetween.

2. An adjustable handleset, which comprises:
a rose;
a handle assembled with the rose at a juncture of assembly;
means for retaining the handle in assembly with the rose;
means for permitting adjustment of the position of the handle relative to the rose at the juncture of assembly, while the retaining means retains the handle in assembly with the rose, and
means for firmly securing the handle with the rose at the juncture of assembly to preclude relative movement therebetween.

3. The adjustable handleset as set forth in claim 2 wherein the means for permitting includes means for swivel adjustment of the handle relative to the rose.

4. The adjustable handleset as set forth in claim 2 wherein the rose and the handle are formed with surfaces at the juncture of assembly which are complementary to permit relative movement of the surfaces to facilitate adjustment of the handle relative to the rose.

5. The adjustable handleset as set forth in claim 4 wherein the complementary surfaces of the handle and the rose at the juncture of assembly are curved.

6. The adjustable handleset as set forth in claim 4 wherein the complementary surfaces of the handle and the rose at the juncture of the assembly are spherical.

7. The adjustable handleset as set forth in claim 2, wherein the rose is a first rose and the handle is assembled with the first rose at one end of the handle, and which further comprises:
a second rose, and
the handle assembled with the second rose at an opposite end of the handle.

8. The adjustable handleset as set forth in claim 7 wherein each of the roses is formed with a door-engaging surface and the means for permitting provides for adjustment of the handle relative to the first rose to facilitate alignment of the door-engaging surfaces in a common plane.

9. The adjustable handleset as set forth in claim 2 wherein the retaining means is a threaded fastener and which further comprises:
a threaded aperture formed in the handle at the juncture of assembly;
a through hole formed in the rose at the juncture of assembly, and
where the threaded fastener is positioned through the through hole from the side of the rose opposite the side where the handle is assembled with the rose and is threadedly located within the threaded aperture.

10. The adjustable handleset as set forth in claim 9 wherein the through hole is formed with facing wall portions which are spaced apart by a distance which is greater than the outside diameter of the threaded fastener to permit lateral transaxis movement of the threaded fastener relative to the axis of the through hole.

11. The adjustable handleset as set forth in claim 2 wherein the securing means is a threaded fastener and which further comprises:
a threaded aperture formed in the handle at the juncture of assembly;
a through hole formed in the rose at the juncture of assembly, and
where the threaded fastener is positioned through the through hole from the side of the rose opposite the side where the handle is assembled with the rose and is threadedly located within the threaded aperture.

12. An adjustable handleset, which comprises:
a rose formed with a spherical recess at a prescribed radius;
a handle formed with a spherical face at the prescribed radius;
the spherical face of the handle being positioned within the spherical recess of the rose at a juncture of assembly;
means for retaining the spherical face within the spherical recess sufficiently to permit movement of the spherical face relative to the spherical recess and thereby permit adjustment of the handle relative to the rose, and
means for securing the handle with the rose to preclude relative movement therebetween.

* * * * *